US006202351B1

(12) United States Patent
Medebach

(10) Patent No.: US 6,202,351 B1
(45) Date of Patent: Mar. 20, 2001

(54) TENSIONING DEVICE FOR THE CABLE PULL OF A WINDOW OPENER

(75) Inventor: Thomas Medebach, Wetzlar-Dudenhofen (DE)

(73) Assignee: Kuster & Co. GmbH, Ehringshausen (DE)

( * ) Notice: Subject to any disclaimer, the term of this patent is extended or adjusted under 35 U.S.C. 154(b) by 0 days.

(21) Appl. No.: 09/323,125

(22) Filed: Jun. 1, 1999

(30) Foreign Application Priority Data

May 29, 1998 (DE) ..... 198 24 131

(51) Int. Cl.[7] ..... E05F 11/48
(52) U.S. Cl. ..... 49/352
(58) Field of Search ..... 49/352, 348, 349, 49/502

(56) References Cited

U.S. PATENT DOCUMENTS 4,657,523 * 4/1987 Chevance et al. ..... 49/352 X
4,984,386 * 1/1991 Marscholl et al. ..... 49/352
5,740,630 * 4/1998 Medebach ..... 49/352
5,749,174 * 5/1998 Mariel ..... 49/352

* cited by examiner

*Primary Examiner*—Jerry Redman
(74) *Attorney, Agent, or Firm*—Liniak, Berenato, Longacre & White

(57) ABSTRACT

A tensioning device (14) for the cable pull of a cable-pull window opener is described, the tensioning device (14) being accommodated in a driver (16) of the window pane, the driver (16) being guided along a guide rail and being fixedly connectable to one end of the cable pull. The tensioning device (14) comprises a spring-loaded directional locking mechanism which can be connected to the other end (8) of the cable pull. The other end (8) of the cable pull is operatively connected to an expanding element (4) which is arranged between latching arms (18) of a latching element (2) guided displaceably in a holder (1) of the driver (16). When the window opener is operated, the latching arms (18) engage, under the effect of the expanding element (4), into a mating toothing arrangement (11) in the holder (1) for the purpose of fixing the other end (8) of the cable pull.

13 Claims, 2 Drawing Sheets

TENSIONING DEVICE FOR THE CABLE PULL OF A WINDOW OPENER

BACKGROUND OF THE INVENTION

1. Field of the Invention

The invention relates to a tensioning device for the cable pull of a cable-pull window opener, in particular for motor vehicles, the tensioning device being accommodated in a driver of the window pane, the driver being along a guide rail and being fixedly connectable to one end of the cable pull, and the tensioning device comprising a spring-loaded directional locking mechanism which can be connected to the other end of the cable pull.

2. Description of the Related Art

A tensioning device of this type is disclosed, for example, in DE 3829680C2, which is included by express reference in the disclosure contents of the present application. This publication discloses a tensioning device for the cable pull of a cable-pull window opener, the tensioning device being accommodated in a driver which is pulled up and down on a guide rail by means of a cable wrapped around a driving drum, one cable end being fixedly connected to the driver and the other cable end being connected to the driver via a directional locking mechanism. The directional locking mechanism consists of a toothed strip on the driver and a part which can be displaced relative to the toothed strip, engages with a tooth into the toothed strip and to which the other cable end is coupled. To compensate for cable stretching between the driver and the displaceable part a compression spring is provided which constantly strives to push the displaceable part having the cable end coupled to it relative to the driver in a cable-tightening direction. A second spring which is stronger than the compression spring is inserted between the displaceable part and the cable end coupled to it. By this means, in the prior art the object is achieved of specifying a tensioning device in which the cable slack produced by excessive application of force on the driving crank is compensated for separately in that during the next downwards movement of the window pane, this cable slack is again taken up in the mechanism in a normal manner while the actual tensioning device is only actuated if there is an actual stretching of the cable.

Another window opener is disclosed in DE 2750904C2. The window opener directs [sic] a cable which is guided in loop form in a Bowden-cable casing, can be unwound and wound up in both directions on a cable drum by means of a driving device and bears a driver which is connected to the window and is guided along a guide rail. Furthermore, a tensioning element is provided which compensates for the length changes occurring as a result of the cable being stressed. The tensioning element has a locking mechanism which inhibits movement of the tensioning element in the slackening direction. The disclosure contents of this publication is also included by express reference in the present application.

The known devices for adjusting the length of the cable pull are structurally of complex design and have an overall form of large proportions. Also, the known tensioning devices are able to be fitted only in a manner which takes up a relatively large amount of time.

In contrast, the invention is based on the object of developing a tensioning device having the features mentioned at the beginning to such an extent that the design and the overall size, and also the fitting of the tensioning device, is [sic] simplified.

SUMMARY OF THE INVENTION

According to the invention this object is achieved in that the other end of the cable pull is operatively connected in a spring-loaded manner to an expanding element which is arranged between latching arms of a latching element guided displaceably in a holder of the driver, and when the window opener is operated, the latching arms engage, under the effect of the expanding element, into a mating toothing arrangement in the holder for the purpose of fixing the other end of the cable pull.

As a result of the fact that when the window opener is operated, the latching arms of the latching element are latched, under the effect of the expanding element, in the mating toothing arrangement in the holder and thus secure the other cable end, an extremely secure latching is ensured with it being possible for the components to be of extremely small dimensions. In the prior art the latching of the spring-elastic limbs of the clip is ensured merely because of the spring elasticity of the limbs themselves. In this respect, the latching element and thus also the holder which holds the latching element can be of considerably smaller size, the load to be transmitted with the relatively small components being comparable to the conventional devices.

According to an advantageous development of the invention, the expanding element is subjected, by a compression spring, to pretensioning which pretensions the expanding element in a cable-pull tightening direction. If the window opener is not operated, the compression spring presses the expanding element, and also the latching element, in a cable-pull tightening direction, and if the cable pull is extended lengthwise the tensioning device is displaced within the holder and the lengthwise stretching of the cable pull is compensated for. When the window opener is operated again, the expanding element latches the latching arms of the latching element in this new position to the mating toothing arrangement in the holder.

The compression spring is preferably held in a blind-hole-like recess adjoining the holder. By this means, the compression spring is, on the one hand, fixed securely to the driver and, on the other hand, the overall size of the tensioning device is also kept small by this measure.

The latching element is essentially designed as a traveling clip having two spring-elastic arms, the expanding element being arranged between the arms. In particular, in contrast to the prior art the traveling clip can be designed as an injection-molded part and can have relatively short latching arms since the latching to the mating toothing arrangement in the holder is carried out by the expanding element which is arranged between the latching arms and not because of the spring elasticity of the latching arms themselves.

The mutually facing internal surfaces of the latching arms advantageously have oblique surfaces which rise toward the free end of the latching arms. These oblique surfaces in interaction with the expanding element are used to securely latch the latching element in the mating toothing arrangement in the holder when the window opener is operated.

The obvious thing here is also for the expanding element to have oblique surfaces which essentially to correspond [sic] to the oblique surfaces of the latching arms, as a result of which the expansion of the latching arms is brought about by an extremely small travel of the expanding element.

For the connection of the expanding element to the other end of the cable pull, said element has an essentially centrally arranged hole through which the other end of the cable pull is guided, a nipple being fastened on the other free end so that a tensile stress on the cable pull is transmitted to the expanding element by the nipple.

The nipple is advantageously held in a chamber between the latching arms of the latching element.

It has proven extremely advantageous here for the nipple to be held in the chamber with axial play, with the axial play, according to an advantageous embodiment, amounting to approximately 3 mm. This measure prevents the cable tensioning being too tight so that a load on, for example, the cable-pull drive or on the corresponding bearings is kept within limits. This also ensures that the window opener to a certain extent runs smoothly.

Furthermore, it has proven advantageous in particular in the case of a cable pull guided in a sheath or tube for the sheath likewise to be fixed on the driver. By this means, rattling noises which otherwise may possibly occur are avoided.

According to another advantageous development of the invention the latching arms have latching teeth on the external surfaces in the region of the free ends. It is of advantage, in particular when the latching element is designed in plastic, for between two and four, in particular three latching teeth to be provided. This measure ensures that the latching element is securely latched in the holder even when a certain amount of abrasion or wear of the latching teeth is taken into consideration.

Finally, there is the possibility of the driver being guided on a guide rail of the window opener by means of a guiding element which preferably consists of plastic.

An exemplary embodiment is explained in the description which follows.

DETAILED DESCRIPTION OF THE PREFERRED EMBODIMENT

Figure 1:
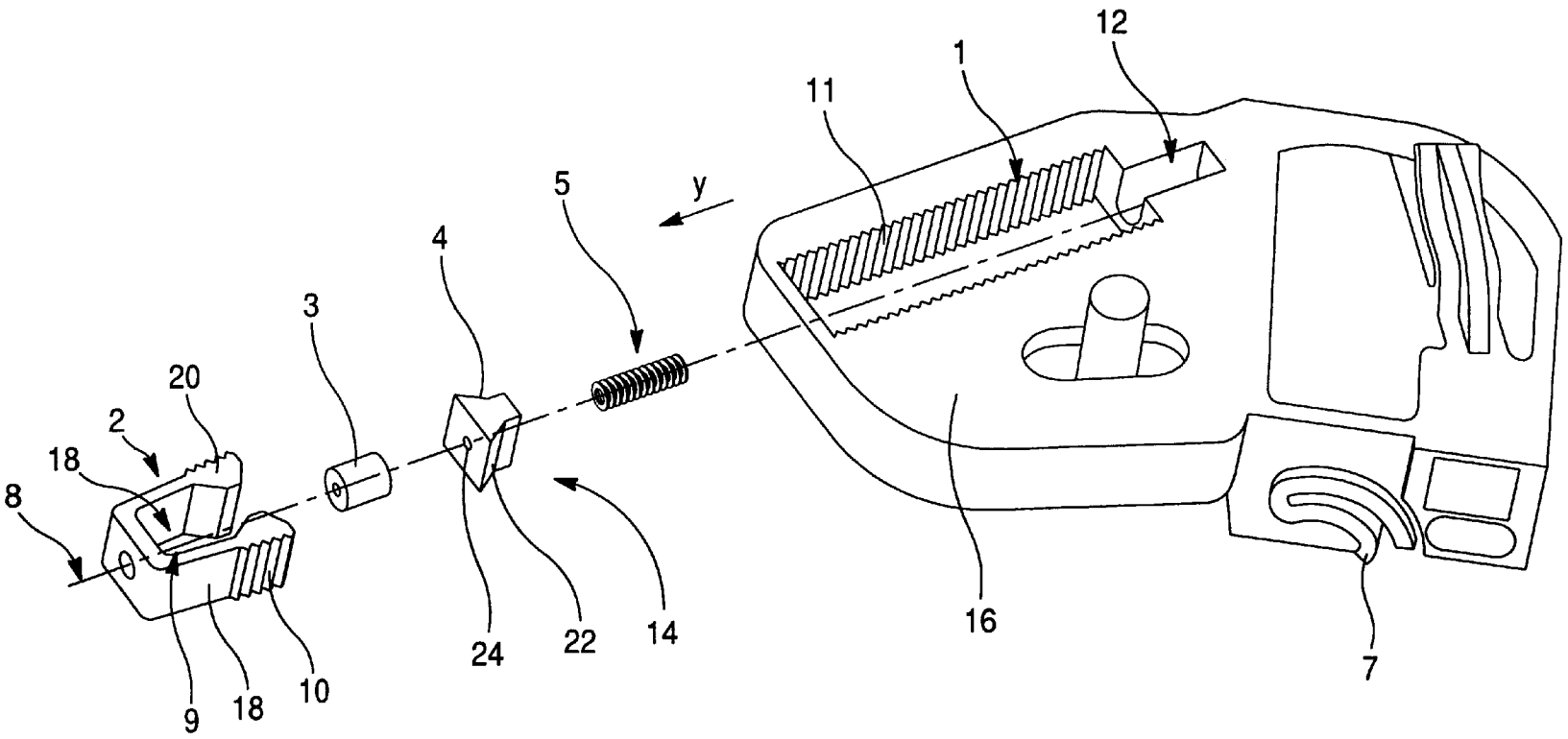
FIG. 1 shows a perspective illustration of the tensioning device and the driver in an exploded illustration.

The driver 16 is connected to the window pane by means of a screw bolt or the like. The driver 16 is furthermore guided displaceably on a guide rail of the window opener via a sliding element 7 which preferably consists of plastic. One end of the cable pull is connected fixedly to the driver 16 while the other cable end 8 of the cable pull is fastened on the tensioning device 14.

The tensioning device 14 has a latching element 2 which is arranged such that it is guided displaceably in a holder 1 of the driver 16. The latching element 2 is essentially designed with two spring-elastic traveling clips, mutually facing internal surfaces of the latching arms 18 having oblique surfaces 20 which rise toward the free end of the latching arms 18. An expanding element 4 is arranged between the latching arms 18. The expanding element 4 has oblique surfaces 22 which essentially correspond to the oblique surfaces 20 of the latching arms 18. A hole 24, through which the other end 8 of the cable pull is guided, is provided in the expanding element 4. The free end 8 is fastened on the expanding element 4 via a nipple 3. The latching arms 18 have latching teeth 10 which are arranged on the external surfaces in the region of the free ends and interact with a mating toothing arrangement 11 in the holder 1 of the driver 16. The nipple 3 is held in a chamber 9 between the latching arms 18 of the latching element with axial play, this play, in a preferred individual case, amounting to approximately 3 mm.

The expanding element 4 is subjected, by a compression spring 5, to pretensioning which pretensions the expanding element 4 in a cable-pull tightening direction. The compression spring 5 is held in a blind-hole-like recess 12 adjoining the holder 1.

Figure 2:
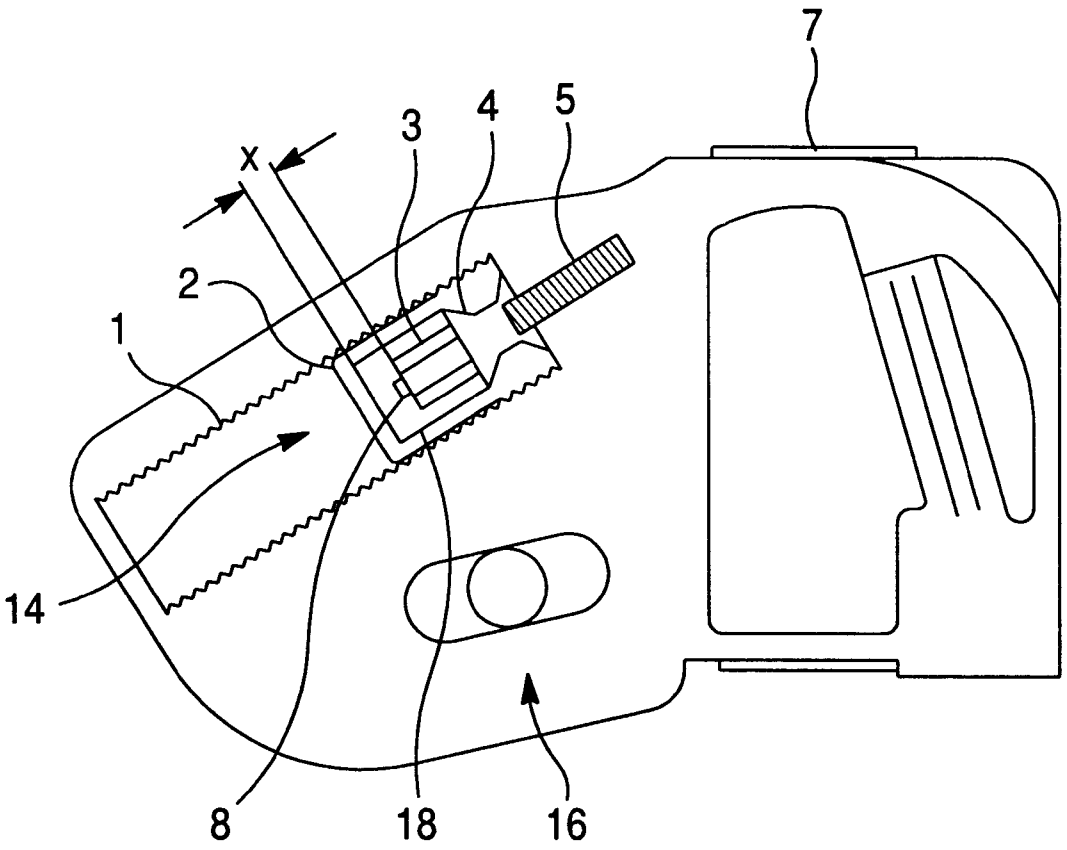
FIG. 2 shows a side view of the fitted tensioning device and driver.

If slack occurs in the cable-pull system, the compression spring 5 acts upon the latching element 2 and pushes the latter in the direction of the arrow Y (FIG. 1) so that the slack is pulled out to a minimum X (FIG. 2). This compensation of the cable slack is, of course, only possible if the window opener is not operated. In the event of the window opener being operated, a tensile force acts upon the other end 8 of the cable pull counter to the arrow direction Y, as a result of which the expanding element 4 with its oblique surfaces 22 drives the latching arms 18 of the latching element 2 apart via the oblique surfaces 20 provided on said element, so that the latching teeth 10 of the latching arms 18 engage into the mating toothing arrangement 11 in the holder 1 and fix the latching element 2 in the holder 1. By this means, the other end 8 of the cable pull is also secured during operation of the window opener.

LIST OF REFERENCE NUMBERS

1 Holder
2 Latching element
3 Nipple
4 Expanding element
5 Compression spring
7 Sliding element
8 Other cable end
9 Chamber
10 Latching teeth
11 Mating toothing arrangement
12 Recess
14 Tensioning device
16 Driver
18 Latching arm
20 Oblique surfaces
22 Oblique surfaces
24 Hole

What is claimed is:

1. A tensioning device (14) in combination with a cable pull of a cable-pull window opener, the tensioning device (14) being accommodated in a driver (16) of a window pane, the driver (16) being guided along a guide rail and being fixedly connectable to one end of the cable pull, and the tensioning device (14) comprising a spring-loaded directional locking mechanism which can be connected to the other end (8) of the cable pull, wherein the other end (8)of the cable pull is operatively connected in a spring-loaded manner to an expanding element (4) which is arranged between latching arms (18) of a latching element (2) which is guided displaceably in a holder (1) of the driver (16), and when the window opener is operated, the expanding element engages the latching arms (18) causing the latching arms to expand into a mating toothing arrangement (11) in the holder (1) for the purpose of fixing the other end (8) of the cable pull.

2. The tensioning device according to claim 1, wherein the expanding element (4) is subjected, by a compression spring (5), to pretensioning which pretensions the expanding element (4) in a cable-pull tightening direction.

3. The tensioning device according to claim 2, wherein the compression spring (5) is held in a recess (12) adjoining the holder (1).

4. The tensioning device according to claim 1, wherein the latching element (2) is essentially designed as a traveling clip having two spring-elastic latching arms (18) and the expanding element (4) is arranged between the latching arms (18).

5. The tensioning device according to claim 4, wherein mutually facing internal surfaces of the latching arms (18) have oblique surfaces (20) which rise toward a free end of the latching arms (18).

6. The tensioning device according to claim 1, wherein the expanding element has oblique surfaces which essentially correspond to the oblique surfaces of the latching arms.

7. The tensioning device according to claim 1, wherein the expanding element has a hole through which the other end (8) of the cable pull is guided, the other free end (8) being connected to the expanding element.

8. The tensioning device according to claim 7, wherein the nipple (3) is held in a chamber (9) between the latching arms (18) of the latching element (2).

9. The tensioning device according to claim 8, wherein the nipple (3) is held in the chamber (9) with axial play.

10. The tensioning device according to claim 9, wherein the axial play amounts to about 3 mm.

11. The tensioning device according to claim 1, wherein the cable pull is guided in a sheath and the sheath is fixed on the driver (16).

12. The tensioning device according to claim 1, wherein the latching arms (18) have latching teeth arranged on the external surfaces adjacent free ends thereof.

13. The tensioning device according to claim 1, wherein the driver (16) is guided on a guide rail of the window opener by means of a sliding element (7) which preferably consists of plastic.

* * * * *